United States Patent [19]

Kendall

[11] Patent Number: 4,468,866

[45] Date of Patent: Sep. 4, 1984

[54] METHOD OF AND APPARATUS FOR VACUUM DRYING OF SYSTEMS

[75] Inventor: Clifford Kendall, Westhoughton, England

[73] Assignee: Hick Hargreaves & Company Limited, Bolton, England

[21] Appl. No.: 445,678

[22] Filed: Nov. 30, 1982

[30] Foreign Application Priority Data

Nov. 30, 1981 [GB] United Kingdom ..... 8136072

[51] Int. Cl.[3] ..... F26B 5/04; F26B 5/06; F26B 13/30

[52] U.S. Cl. ..... 34/15; 34/5; 34/92

[58] Field of Search ..... 34/5, 92, 15

[56] References Cited

U.S. PATENT DOCUMENTS 1,858,409 5/1932 Mittelsteiner ..... 34/92

3,234,661 2/1966 Nerge ..... 34/5

*Primary Examiner*—John J. Camby

*Attorney, Agent, or Firm*—Pravel, Gambrell, Hewitt, Kirk & Kimball

[57] ABSTRACT

A method of and apparatus for vacuum drying a system, wherein the system is evacuated to effect vaporization of a liquid therein and facilitate its removal from the system, wherein at least one sample of the liquid is positioned within the system. The temperature of each sample and of the free space thereabove are monitored and the system is evacuated at a controlled rate so as to maintain the temperature of each sample at or above a pre-set temperature differential with respect to the free space thereinabove, as the temperature of the free space approaches the freezing point of the liquid until evaporation of all the samples is complete and the system is evacuated down to a practically achievable absolute pressure. The system is then isolated and the temperature of the system is allowed to rise, thereby causing any frozen liquid within the system to sublime or re-evaporate. The time taken for the system to reach a steady state value is monitored to indicate the sublimation rate or heat transfer rate of the system and the remaining liquid is evacuated at a rate below the sublimation rate or heat transfer rate to prevent further freezing.

8 Claims, 1 Drawing Figure

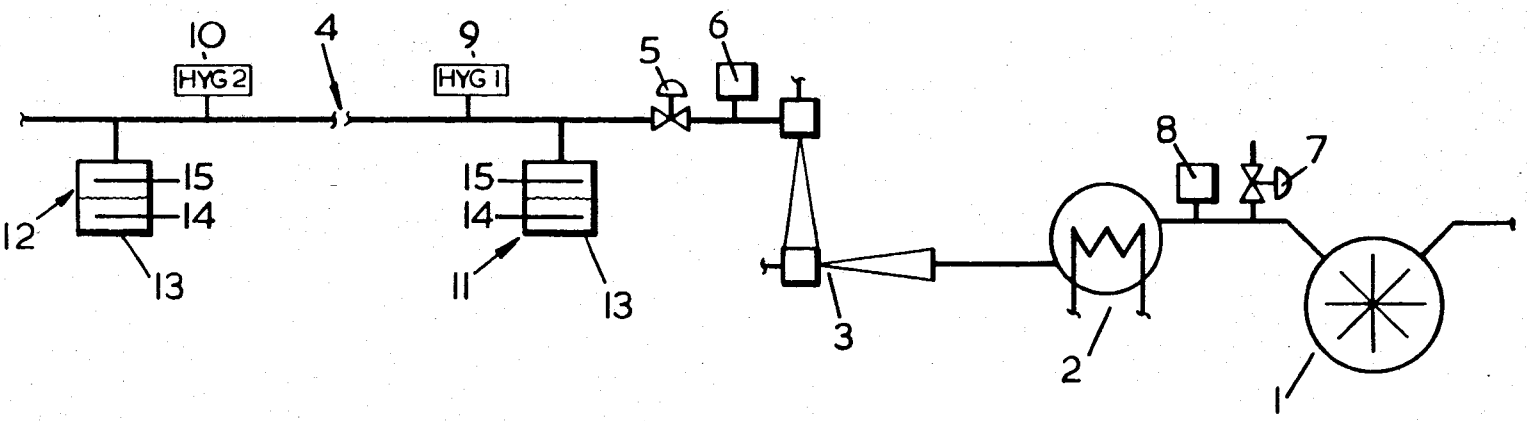
1
2
3
4
5
6
7
8
9
HYG 1
10
HYG 2
11
12
13
14
15

METHOD OF AND APPARATUS FOR VACUUM DRYING OF SYSTEMS

The present invention relates to a method of, and apparatus for, vacuum drying of systems, for example, gas pipeline systems.

In order to prevent the formation of corrosive hydrates in gas pipelines it is necessary to ensure that the pipeline is dried to a pre-set dew-point before the introduction of gas into the pipeline.

In order to dry the line several methods are known, for example, a methanol drying method in which one or several methanol plugs between scrapers are run through the line. This method is relatively rapid, but methanol is costly, and has a low flash point and is therefore dangerous. Furthermore, methanol is also poisonous.

In order to avoid the above-mentioned problems inherent in the aforementioned methanol drying method it is known to dry the line be inducing a vacuum in the line to vapourise water on the pipeline walls, under the boiling pressure corresponding to the line temperature, and then pumping it out. This method is particularly advantageous because it allows the whole line to be filled with gas in total safety, without the prior nitrogen sweeping of the methanol method because of the low residual oxygen content of the line. However, it does suffer from the disadvantage that where the line is pumped down too rapidly, relative to the line heat transfer rate, ice plugs form within the pipeline. The water contained within the ice plugs cannot, of course, vapourise until sufficient heat is provided from the system itself, thus allowing either sublimation or, more efficiently, re-evaporation through the water phase. Clearly, it is desirable to execute the drying operation as quickly as possible, however, if it is done too rapidly the water freezes thus defeating the object of vacuum drying. Obviously, ice formation reduces the heat transfer rate capability of the system and requires additional heat input to remelt the ice. Freezing of water in the line due to too rapid evacuation of the line is a particular problem in very large line systems. It can take several days to bring the absolute pressure within the system down to the required level to achieve evaporation. Accordingly, repeatedly evacuating the line too rapidly, and causing freezing, can lead to complete drying of the line taking a considerable period of time.

It is an object of the present invention to provide a vacuum drying system in which the above mentioned problems are obviated or mitigated.

According to the present invention there is provided a method of vacuum drying a system, wherein the system is evacuated to effect vapourisation of a liquid therein and facilitate its removal from the system, characterised in that at least one sample of the liquid is positioned within the system, the temperatures of each sample and of the free space thereabove are monitored, the system is evacuated at a controlled rate so as to maintain the temperature of each sample at or above a pre-set temperature differential with respect to the free space thereinabove, as the temperature of the free space approaches the freezing point of the liquid, until evaporation of all the samples is complete and the system is evacuated down to a practically achievable absolute pressure, whereupon the system is isolated and the temperature of the system is allowed to rise, thereby causing any frozen liquid within the system to sublime or re-evaporate, the time taken for the system to reach a steady state value is monitored to indicate the sublimation rate or heat transfer rate of the system and the remaining liquid is evacuated at a rate below the sublimation rate or heat transfer rate of the system to prevent further freezing.

Preferably, each sample of liquid may be replenished during the evacuation process in the event of its drying out before the system is evacuated down to absolute pressure.

Preferably, where the system to be dried is large, samples of liquid are positoned at various distances from the point of evacuation to offset the effects of pressure drop due to gas flow.

According to a second aspect of the present invention there is provided apparatus for vacuum drying a system comprising means for evacuating the system to effect vapourisation of a liquid therein and facilitate its removal from the system, characterised in that the apparatus further comprises means for holding at least one sample of the liquid within the system, temperature sensing means for monitoring the temperatures of each sample and of the free space thereabove, means for controlling the rate of evacuation of the system so as to maintain the temperature of each sample at or above a pre-set temperature differential with respect to the free space thereinabove, as the temperature of the free space approaches the freezing point of the liquid until evaporation of the sample is completed and the system is evacuated down to a practically achievable absolute pressure, means for isolating the system, means for monitoring any rise in the pressure therein and the time taken for the pressure to reach a steady state value to indicate the sublimation rate or heat transfer rate of the system, and means for evacuating the system once more at a controlled rate of evacuation to be below the sublimation rate or heat transfer rate to prevent further freezing.

Preferably each sample of liquid is located within a liquid sample holding pot positioned within the system and means are provided for topping up each pot in the event of its evaporating dry before the system is evacuated down to absolute pressure.

Preferably, the temperature sensing means for monitoring the temperature of each sample and of the free space thereabove, comprises a pair of thermocouples one of which is located within the liquid sample holding pot and the other one of which is located in the free space thereabove.

An embodiment of the present invention will now be described, by way of example, with reference to the accompanying drawing, which shows a schematic view of a vacuum drying system embodying the present invention for large systems.

Referring to the accompanying drawing there is shown a liquid ring pump 1 (LRP) connected through a heat exchanger 2 to a two stage steam augmentor 3 which is in turn connected to a system 4 to be dried. An isolating valve 5 is connected between the system 4 and the evacuating equipment 1, 2 and 3 which acts to throttle the steam augmentor 3 to prevent overloading of the LRP 1 by the augmentor 3 and to control the rate of evacuation of the system 4. The isolating valve 5 is controlled by a pressure sensing control device 6. Another valve 7 is connected between atmosphere and the input to LRP 1 to provide ballast air to the LRP 1. The valve 7 is controlled by a pressure sensing control device 8.

Within the actual system 4 itself there are provided two hygrometers 9 and 10 to measure the moisture in the system. Hygrometer 9 is located near the input to the evacuating equipment, whilst hygrometer 10 is located at some extremity of the system 4 therefrom.

Also provided within the system 4 are two sets 11 and 12 of water vapour temperature differential monitoring equipment. Each set of temperature differential monitoring equipment comprises a water sample pot 13, a temperature sensing device 14 located within the pot 13 and a temperature sensing device 15 located in the free space above the pot 13. Set 11 is located mear the input to the evacuating equipment, whilst set 12 is located at some extremity of the system 4 therefrom.

Operation of the system will now be described herebelow.

In order to effect evaporation control it is necessary to effect a balance between the rate of reduction in the absolute pressure of the system and the corresponding saturated vapour pressure of the water remaining in the system. The rate of reduction of the absolute pressure is dependent on various factors such as the heat transfer rate of the system, the quantity of water remaining in the system and its temperature. Since none of the parameters are known for the system the water samples within the sample pots 13 are monitored as being indicative of the water within the system. By controlling the rate of evacuation of the system throughout the evaporation period so that the water samples within the sample pots do not freeze, removal of most of the water within the system can be achieved.

In order to effect vacuum drying initially the LRP 1 is commissioned with valve 5 fully open and valve 7 fully closed until the correct interstage pressure for the particular LRP 1 used is reached. Once this point is reached the system 4 is isolated by closing valve 5 and the steam augmentor 3 is commissioned. Where necessary, valve 7 is opened to provide ballast air to the LRP 1. Once the steam augmentor 3 is running satisfactorily valve 5 is slowly opened and evacuation of the system 4 continued. At the same time valve 7 is slowly closed. At this stage the degree of throttling valve 5 controls the rate of evacuation of the system and also ensures that the steam augmentor 3 does not overload the LRP 1. Throughout the evacuation process the rate of evacuation is controlled to ensure that a pre-set differential between temperature sensing devices 14 and 15 is not exceeded. As the pressure within the system 4 drops still further control of the temperature of the water within the pots 13 becomes a priority over matching the steam augmentor 3 to the LRP 1 and valve 7 may be opened to ensure matching between the two pieces of equipment. This process is continued through the entire evaporation plateau of the system until at the end of the evaporation period temperature sensing devices 14 and 15 indicate the same temperature and hygrometers 9 and 10 the same moisture reading. It will be appreciated that in case the sample pots 13 dry out before the end of the evaporation plateau is reached means are provided whereby the sample pots may be topped up.

Once the evaporation process is concluded the pressure within the pipeline is brought down to the absolute limit of the evacuating equipment at which stage the system 4 is isolated by closing valve 5, and the system 4 left to "soak" to check that ice plugs have not formed during evacuation. In the event that the pressure within the pipeline does rise over the "soak" period, this pressure rise will be due to the sublimation or remelting of ice to water vapour. By using the time taken for the pressure to rise to a steady state value and the known volume of the system the valves 5 and 7 can be set so that the capacity of the vacuum equipment is controlled to evacuate the system 4 at a rate less than the sublimation rate or heat transfer rate which caused the pressure to rise. Accordingly the system 4 can now be completely dried without freezing of the water present occuring.

It will be appreciated that the number of sets of temperature differential monitoring equipment provided within the system to be evacuated may be varied according to the size of the system. Accordingly, where the system is small only one set need be provided and where the system is large two sets need not be the limit. This also applies to the number of hygrometers provided within the system.

What we claim is:

1. A method of vacuum drying a system to remove a liquid therefrom comprising the steps of:

positioning at least one sample of the liquid within at least one sample enclosure within the system;

monitoring the temperature differential between the sample positioned within the system and the free space adjacent that sample;

connecting the system to a vacuum producing means;

evacuating the system down to a practically achievable absolute pressure at a controlled rate so as to maintain the temperature differential between each sample within the system and the free space above that sample at or above a preset level, as the temperature of the free space approaches the freezing point of the liquid until evaporation of the sample is substantially complete;

isolating the system from the vacuum producing means;

allowing the temperature of the system to rise to facilitate sublimation or reevaporation of any frozen liquid remaining within the system;

monitoring the time taken for the pressure within the system to reach a steady state value;

determining the sublimation rate or heat transfer rate of the system from the monitored time taken for the pressure within the system to reach the steady state value; and evacuating the remaining liquid from the system at a rate below the determined sublimation rate or heat transfer rate of the system to prevent further freezing of the liquid remaining within the system.

2. The method of claim 1 further including the step of:

replenishing each sample of liquid in a sample enclosure within the system during said step of evacuating the system in the event the sample enclosure dries out before the system is evacuated down to the practically achievable absolute pressure.

3. The method of claim 1 wherein, the step of positioning a sample in a sample enclosure within the system further comprises the step of:

positioning samples of liquid in sample enclosures at various points from the point of evacuation within the system.

4. The method of claim 1 wherein, the liquid in the sample enclosure is water.

5. A vacuum drying apparatus to remove a liquid from a system containing a gas laden free space comprising:

at least one container means for holding a sample of liquid within the system;

a temperature sensor for determining the temperature differential between the sample of liquid in said container means and the free space in the system adjacent said container means;

a vacuum producing means for changing the pressure within the system;

control means for controlling the rate at which said vacuum producing means evacuates the system down to a practically achievable absolute pressure so as to maintain the pressure differential between the sample of liquid held in said container means and the free space in the system adjacent said container means at or above a preset level as the temperature of the free space approaches the freezing point of the liquid until evaporation of the sample is completed;

means for isolating the system from said vacuum producing means;

a pressure sensor for monitoring any rise in pressure in the system;

a means for determining the time taken for the pressure in the system to reach a steady state value to indicate the sublimation rate or heat transfer rate of the system, said control means further maintaining the rate of evacuation of the system below the sublimation rate or heat transfer rate which caused any rise in pressure in the system, thereby preventing further freezing.

6. The apparatus of claim 5, wherein said temperature sensor comprises:

a pair of thermocouples, one of which is located within said container means and the other of which is located in the free space above said container means.

7. The apparatus of claim 5, further including:

liquid sensing means for sensing the presence of liquid within said container means.

8. The apparatus of claim 7, wherein the liquid within said container means is water and said liquid sensing means comprises at least one hygrometer.

* * * * *